US006781074B1

(12) United States Patent
Fong et al.

(10) Patent No.: US 6,781,074 B1
(45) Date of Patent: Aug. 24, 2004

(54) PREVENTING CORROSION DEGRADATION IN A FLUID-BASED SWITCH

(75) Inventors: Arthur Fong, Colorado Springs, CO (US); Marvin Glenn Wong, W odland Park, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/630,172

(22) Filed: Jul. 30, 2003

(51) Int. Cl.[7] ..... H01H 29/00
(52) U.S. Cl. ..... 200/182
(58) Field of Search ..... 200/182, 187–189, 200/209–219, 233–236; 310/328, 331, 348, 363; 335/4, 47, 78; 385/19

(56) References Cited

U.S. PATENT DOCUMENTS

| | | | | |
|---|---|---|---|---|
| 2,312,672 A | | 3/1943 | Pollard, Jr. | |
| 2,564,081 A | | 8/1951 | Schilling | |
| 3,430,020 A | | 2/1969 | Tomkewitsch et al. | |
| 3,529,268 A | | 9/1970 | Rauterberg | |
| 3,600,537 A | | 8/1971 | Twyford | |
| 3,639,165 A | | 2/1972 | Rairden, III | |
| 3,657,647 A | | 4/1972 | Beusman et al. | |
| 3,955,059 A | * | 5/1976 | Graf | 200/181 |
| 4,103,135 A | | 7/1978 | Gomez et al. | |
| 4,158,118 A | * | 6/1979 | Graf | 137/251.1 |
| 4,200,779 A | | 4/1980 | Zakurdaev et al. | |
| 4,238,748 A | | 12/1980 | Goullin et al. | |
| 4,245,886 A | | 1/1981 | Kolodzey et al. | |
| 4,336,570 A | | 6/1982 | Brower | |
| 4,419,650 A | | 12/1983 | John | |
| 4,434,337 A | | 2/1984 | Becker | |
| 4,475,033 A | | 10/1984 | Willemsen et al. | |
| 4,505,539 A | | 3/1985 | Auracher et al. | |
| 4,582,391 A | | 4/1986 | Legrand | |
| 4,628,161 A | | 12/1986 | Thackrey | |
| 4,652,710 A | | 3/1987 | Karnowsky et al. | |
| 4,657,339 A | | 4/1987 | Fick | |
| 4,742,263 A | | 5/1988 | Harnden, Jr. et al. | |
| 4,786,130 A | | 11/1988 | Georgiou et al. | |
| 4,797,519 A | | 1/1989 | Elenbaas | |
| 4,804,932 A | | 2/1989 | Akanuma et al. | |

(List continued on next page.)

FOREIGN PATENT DOCUMENTS

| | | |
|---|---|---|
| EP | 0593836 A1 | 4/1994 |
| FR | 2418539 | 9/1979 |

(List continued on next page.)

OTHER PUBLICATIONS

TDB–ACC–NO: NB8406827, "Integral Power Resistors For Aluminum Substrate", IBM Technical Disclosure Bulletin, Jun. 1984, US, vol. 27, Issue No. 1B, p. 827.

(List continued on next page.)

*Primary Examiner*—Michael A. Friedhofer
(74) *Attorney, Agent, or Firm*—Cynthia S. Mitchell

(57) ABSTRACT

Fluid-based switch and methods for reducing oxides and corrosion products on switching fluid are disclosed. In one method, oxides are reduced by depositing a switching fluid on a first substrate, coating the switching fluid with a corrosion inhibitor, and mating the first substrate to a second substrate, the first substrate and the second substrate defining therebetween a cavity holding the switching fluid, the cavity being sized to allow movement of the switching fluid between first and second states.

18 Claims, 4 Drawing Sheets

U.S. PATENT DOCUMENTS

| | | | | |
|---|---|---|---|---|
| 4,988,157 | A | | 1/1991 | Jackel et al. |
| 5,278,012 | A | | 1/1994 | Yamanaka et al. |
| 5,415,026 | A | | 5/1995 | Ford |
| 5,502,781 | A | | 3/1996 | Li et al. |
| 5,644,676 | A | | 7/1997 | Blomberg et al. |
| 5,675,310 | A | | 10/1997 | Wojnarowski et al. |
| 5,677,823 | A | | 10/1997 | Smith |
| 5,751,074 | A | | 5/1998 | Prior et al. |
| 5,751,552 | A | | 5/1998 | Scanlan et al. |
| 5,828,799 | A | | 10/1998 | Donald |
| 5,841,686 | A | | 11/1998 | Chu et al. |
| 5,849,623 | A | | 12/1998 | Wojnarowski et al. |
| 5,874,770 | A | | 2/1999 | Saia et al. |
| 5,875,531 | A | | 3/1999 | Nellissen et al. |
| 5,886,407 | A | | 3/1999 | Polese et al. |
| 5,889,325 | A | | 3/1999 | Uchida et al. |
| 5,912,606 | A | | 6/1999 | Nathanson et al. |
| 5,915,050 | A | | 6/1999 | Russell et al. |
| 5,972,737 | A | | 10/1999 | Polese et al. |
| 5,994,750 | A | | 11/1999 | Yagi |
| 6,021,048 | A | | 2/2000 | Smith |
| 6,180,873 | B1 | | 1/2001 | Bitko |
| 6,201,682 | B1 | | 3/2001 | Mooij et al. |
| 6,207,234 | B1 | | 3/2001 | Jiang |
| 6,212,308 | B1 | | 4/2001 | Donald |
| 6,225,133 | B1 | | 5/2001 | Yamamichi et al. |
| 6,278,541 | B1 | | 8/2001 | Baker |
| 6,304,450 | B1 | | 10/2001 | Dibene, II et al. |
| 6,320,994 | B1 | | 11/2001 | Donald et al. |
| 6,323,447 | B1 | * | 11/2001 | Kondoh et al. ..... 200/182 |
| 6,351,579 | B1 | | 2/2002 | Early et al. |
| 6,356,679 | B1 | | 3/2002 | Kapany |
| 6,373,356 | B1 | | 4/2002 | Gutierrez et al. |
| 6,396,012 | B1 | | 5/2002 | Bloomfield |
| 6,396,371 | B2 | | 5/2002 | Streeter et al. |
| 6,408,112 | B1 | | 6/2002 | Bartels |
| 6,446,317 | B1 | | 9/2002 | Figueroa et al. |
| 6,453,086 | B1 | | 9/2002 | Tarazona |
| 6,470,106 | B2 | | 10/2002 | McClelland et al. |
| 6,487,333 | B2 | | 11/2002 | Fouquet |
| 6,501,354 | B1 | | 12/2002 | Gutierrez et al. |
| 6,512,322 | B1 | | 1/2003 | Fong et al. |
| 6,515,404 | B1 | | 2/2003 | Wong |
| 6,516,504 | B2 | | 2/2003 | Schaper |
| 6,559,420 | B1 | | 5/2003 | Zarev |
| 6,633,213 | B1 | | 10/2003 | Dove |
| 6,646,527 | B1 | * | 11/2003 | Dove et al. ..... 335/47 |
| 6,647,165 | B2 | * | 11/2003 | Hu et al. ..... 385/16 |
| 2002/0037128 | A1 | | 3/2002 | Burger et al. |
| 2002/0146197 | A1 | | 10/2002 | Yong |
| 2002/0150323 | A1 | | 10/2002 | Nishida et al. |
| 2002/0168133 | A1 | | 11/2002 | Saito |
| 2003/0035611 | A1 | | 2/2003 | Shi |

FOREIGN PATENT DOCUMENTS

| | | |
|---|---|---|
| FR | 2458138 | 12/1980 |
| FR | 2667396 | 4/1992 |
| JP | 36-18575 | 10/1961 |
| JP | SHO47-21645 | 10/1972 |
| JP | 62-276838 | 12/1987 |
| JP | 63-294317 | 12/1988 |
| JP | 8-125487 | 5/1996 |
| JP | 9-161640 | 6/1997 |
| WO | WO99-46624 | 9/1999 |

OTHER PUBLICATIONS

Bhedwar, Homi C., et al., "Ceramic Multilayer Package Fabrication", Electronic Materials Handbook, Nov. 1989, pp. 460–469, vol. 1 Packaging, Section 4: Packages.

Simon, Jonathan, et al., "A Liquid–Filled Microrelay With a Moving Mercury Microdrop", Journal of Microelectromechanical Systems, Sep. 1997, pp. 208–216, vol. 6, No. 3.

* cited by examiner

PREVENTING CORROSION DEGRADATION IN A FLUID-BASED SWITCH

BACKGROUND OF THE INVENTION

Liquid metal micro switches (LIMMS) have been made that use a liquid metal, such as mercury, gallium-bearing alloys or other liquid metal compositions, as the switching fluid. The liquid metal may make, break or latch electrical contacts. To change the state of the switch, a force is applied to the switching fluid, which causes it to change form and move. Liquid metal switches rely on the cleanness of the liquid metal for good performance. If the liquid metal forms oxide films or other types of corrosion product buildup within the switch, the proper functioning or performance of the switch may degrade or be inhibited.

For example, the oxide film or other corrosion products may increase the surface tension of the liquid metal, which may increase the energy required for the switch to change state. Films of oxide and other corrosion products may increase the tendency for the liquid metal to wet to the substrate between switch contacts, thereby increasing undesirable short circuits in the switching operation. Build up of oxide and other corrosion products may also degrade the ability of the liquid metal to wet to the switch contacts, and thereby may increase the probability of undesirable open circuits in the switching operation. The build up of oxide and other corrosion products within the liquid metal switch may also alter the effective surface tension of the liquid metal with itself, causing the liquid metal to become stringy when moved or stretched, and thereby decreasing the tendency of the liquid metal to break cleanly between switch contacts and potentially causing short circuits. Build up of large amounts of oxide or corrosion products may increase the effective viscosity of the liquid metal leading to slower switch operation over time.

It is desirable to have liquid metal that is as free of oxide and other corrosion products as practically possible in order to minimize the above mentioned negative effects. There is a need for a method to decrease or eliminate the build up of oxide or other corrosion products in liquid metal switches.

SUMMARY OF THE INVENTION

In one embodiment, a method for reducing oxides and corrosion products on a switching fluid is disclosed. The method includes depositing a switching fluid on a first substrate. The first substrate is mated to a second substrate, the first substrate and the second substrate defining therebetween a cavity holding the switching fluid. The cavity is sized to allow movement of the switching fluid between first and second states. The switching fluid is coated with a corrosion inhibitor.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION

Figure 1:
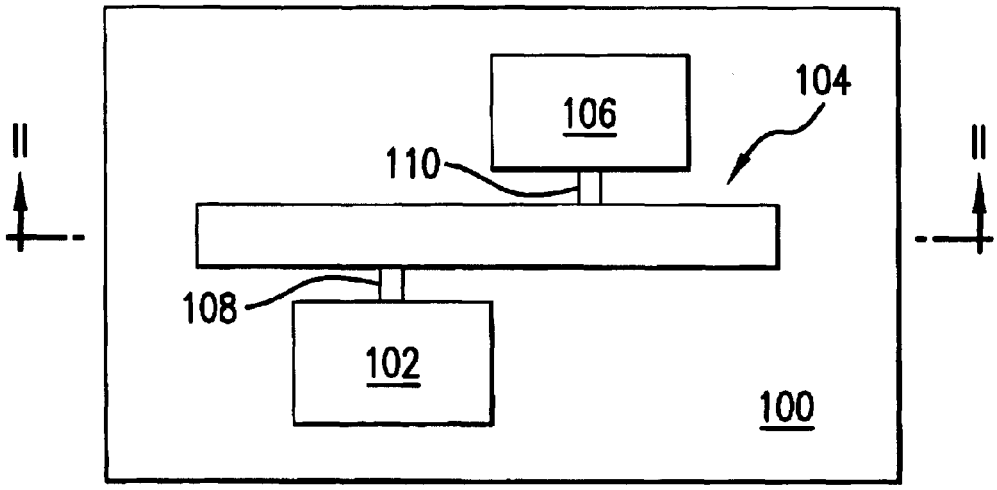
FIG. 1 illustrates a plan view of a first exemplary embodiment of a fluid-based switch.
Figure 2:
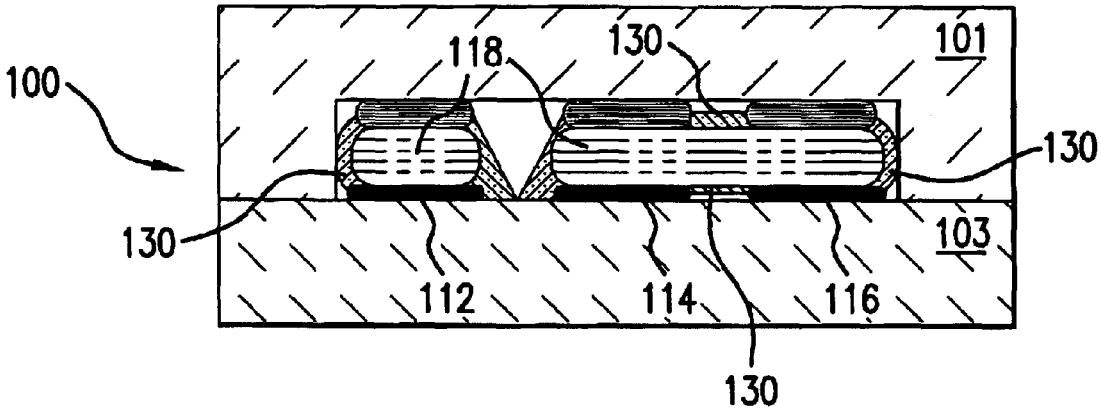
FIG. 2 illustrates an elevation of the switch shown in FIG. 1.

FIGS. 1 and 2 illustrate a fluid-based switch such as a LIMMS. The switch 100 includes a switching fluid cavity 104, a pair of actuating fluid cavities 102, 106, and a pair of cavities 108, 110 that connect corresponding ones of the actuating fluid cavities 102, 106 to the switching fluid cavity 104. It is envisioned that more or fewer channels may be formed in the switch. For example, the pair of actuating fluid cavities 102, 106 and pair of connecting cavities 108, 110 may be replaced by a single actuating fluid cavity and single connecting cavity.

Figure 3:
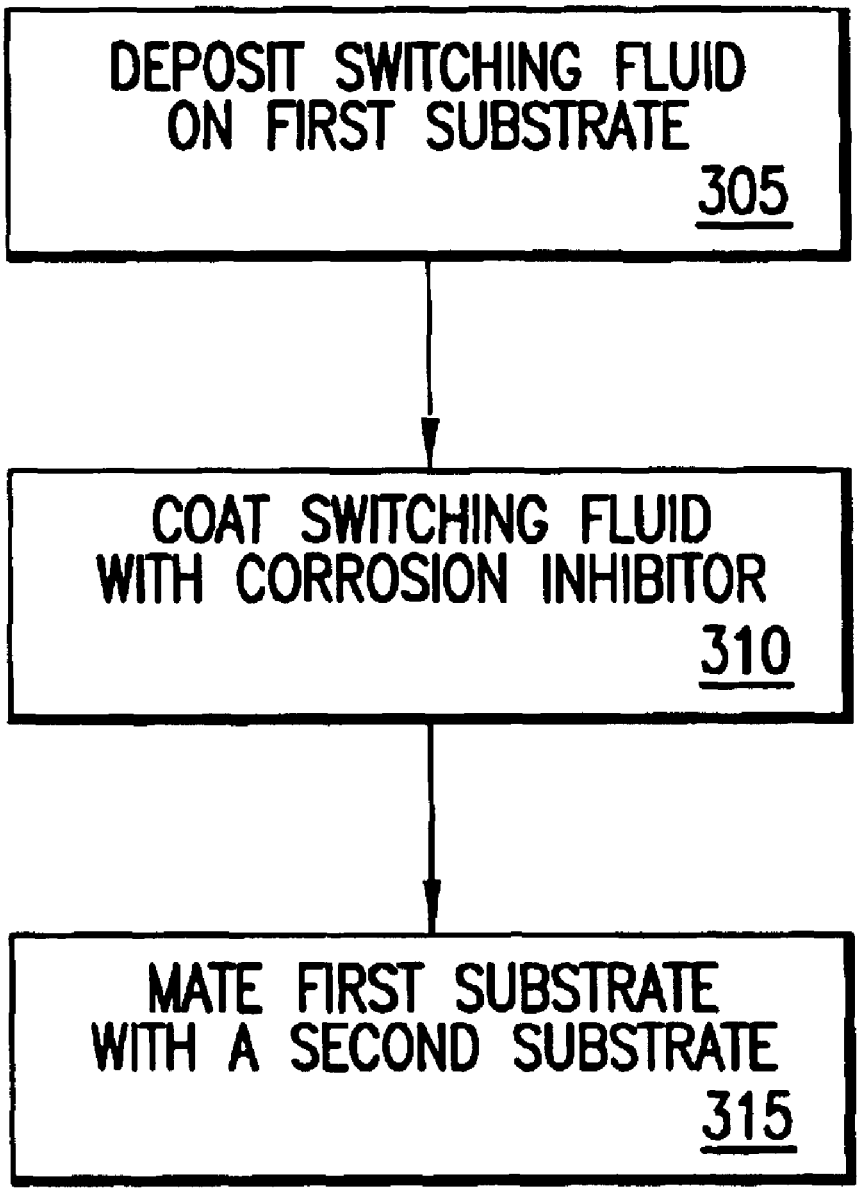
FIG. 3 illustrates an exemplary method that may be used to produce the fluid-bases switch of FIGS. 1 and 2.

As illustrated by FIG. 3, the switch 100 may be produced by depositing 305 a switching fluid 118 on a plurality of contacts 112–116 on a first substrate 103. In one embodiment, the switching fluid may be a liquid metal, such as mercury or alloys that contain gallium. As will be described in further detail below, the switching fluid 118 may be used to make and break contact between the contacts 112, 114, 116. In an alternate embodiment, the switching fluid may be deposited on a plurality of wettable pads and may be used to open and block light paths. Although the switch illustrated in FIG. 2 includes three contacts, it should be appreciated that alternate embodiments may have a different number of contacts.

Next, Liquid corrosion inhibitor 130 is dispensed onto the liquid metal drops in operation 310. Then, the first substrate 103 is mated 315 to a second substrate 101 so that a cavity holding the switching fluid 118 is defined between the two substrates. The cavity is sized to allow movement of the switching fluid 118 between first and second states. The coating may be done before, during or after the process of mating the substrates. The coating step may be accomplished by dispensing or jetting (similar to the jetting of inkjet drops). The mating step may be accomplished by any known means, such as lamination or wafer-to-wafer bonding.

The liquid corrosion inhibitor 130 may be used to help reduce or prevent oxides from forming on the switching fluid. By way of example, when mercury is used as the switching fluid, the liquid corrosion inhibitor may coat the surface of the liquid metal 118 and may be an oily substance that is substantially inert with mildly chemically reducing properties. The inert oily properties may promote coating the liquid metal surface 118 so that gaseous corrosive agents, such as oxygen, are substantially prevented from contact with the liquid metal 118. The chemical reducing properties may reduce corrosion products, such as oxides of the liquid metal, back to their elemental form, which is particularly important when using active metals, such as gallium-bearing alloys for the switching metal 118.

By way of example only, one possible liquid corrosion inhibitor may be Cortec VCI-369", which is a proprietary mix of corrosion inhibitors in light mineral oil that has relatively good resistance to high temperature. Other corrosion inhibitors may be used, such as "Cortec VCI-327", which is a proprietary mix of corrosion inhibitors in mineral spirits. Both "Cortec VCI-369" and "Cortec VCI-327" are proprietary products of Cortec Corporation, having a corporate headquarters located at Saint Paul, Minn.

Figure 4:
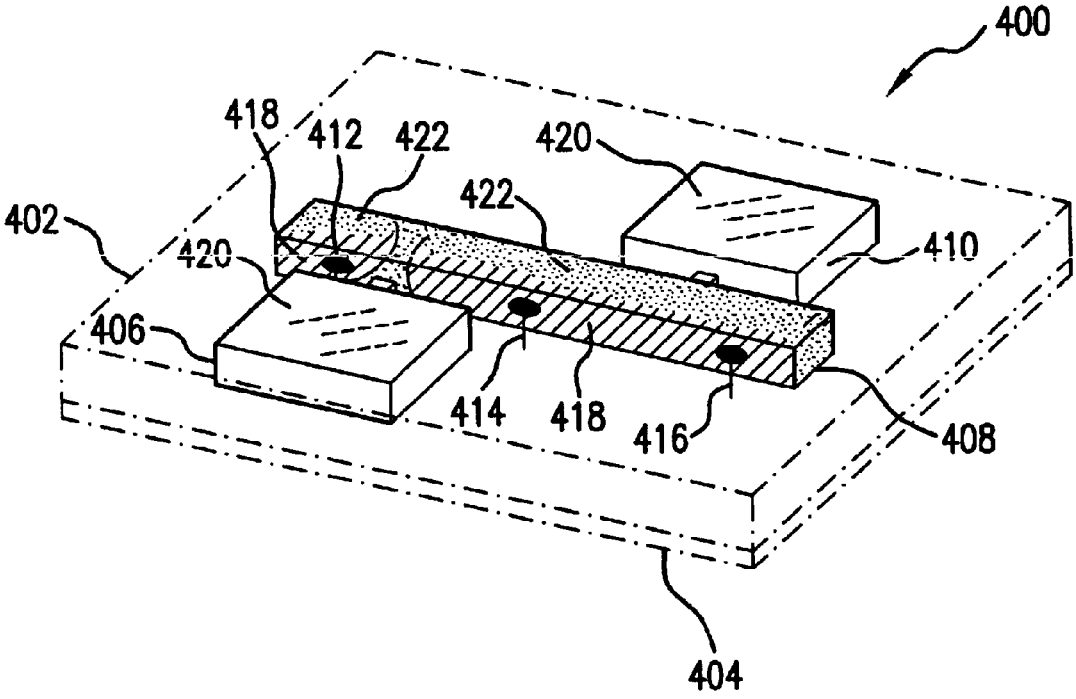
FIG. 4 illustrates a perspective view of an exemplary embodiment of a switch including an oxide or corrosion inhibitor in a fluid based switch.

The functioning of a switch according to one embodiment can be explained with reference to FIG. 4. The switch 400 comprises a first substrate 402 and a second substrate 404 mated together. The substrates 402 and 404 define between them a number of cavities 406, 408, and 410. Exposed within one or more of the cavities are a plurality of electrodes 412, 414, 416. A switching fluid 418 (e.g., a conductive liquid metal such as mercury) held within one or more of the cavities serves to open and close at least a pair of the plurality of electrodes 412–416 in response to forces that are applied to the switching fluid 418. An actuating fluid 420 (e.g., an inert gas or liquid) held within one or more of the cavities serves to apply the forces to the switching fluid 418.

In one embodiment of the switch 400, the forces applied to the switching fluid 418 result from pressure changes in the actuating fluid 420. The pressure changes in the actuating fluid 420 impart pressure changes to the switching fluid 418, and thereby cause the switching fluid 418 to change form, move, part, etc. In FIG. 4, the pressure of the actuating fluid 420 held in cavity 406 applies a force to part the switching fluid 418 as illustrated. In this state, the rightmost pair of electrodes 414, 416 of the switch 400 are coupled to one another. If the pressure of the actuating fluid 420 held in cavity 406 is relieved, and the pressure of the actuating fluid 420 held in cavity 410 is increased, the switching fluid 418 can be forced to part and merge so that electrodes 414 and 416 are decoupled and electrodes 412 and 414 are coupled.

By way of example, pressure changes in the actuating fluid 420 may be achieved by means of heating the actuating fluid 420, or by means of piezoelectric pumping. The former is described in U.S. Pat. No. 6,323,447 of Kondoh et al. entitled "Electrical Contact Breaker Switch, Integrated Electrical Contact Breaker Switch, and Electrical Contact Switching Method", which is hereby incorporated by reference for all that it discloses. The latter is described in U.S. patent application Ser. No. 10/137,691 of Marvin Glenn Wong filed May 2, 2002 and entitled "A Piezoelectrically Actuated Liquid Metal Switch", which is also incorporated by reference for all that it discloses. Although the above referenced patent and patent application disclose the movement of a switching fluid by means of dual push/pull actuating fluid cavities, a single push/pull actuating fluid cavity might suffice if significant enough push/pull pressure changes could be imparted to a switching fluid from such a cavity. Additional details concerning the construction and operation of a switch such as that which is illustrated in FIG. 4 may be found in the afore-mentioned patent of Kondoh.

Switch 400 further includes corrosion inhibitor 422 (e.g., Cortec VCI-369 or Cortec VCI-327) coating switching fluid 418 within the cavity 408. In one embodiment, corrosion inhibitor 422 may be used to coat switching fluid 418 and helping to prevent corrosive agents and products from forming on switching fluid 418. The switching fluid 418 is able to switch even with the corrosion inhibitor coating the switching fluid 118, by means of the surface tension of the switching fluid being able push the corrosion inhibitor coating out of the way to "close the switch" and the viscosity of the corrosion inhibitor being low enough to not pose a detriment when "opening" the switch.

A second exemplary embodiment of the functioning of a switch 500 will now be described with reference to FIG. 5. The switch 500 comprises a substrate 502 and a second substrate 504 mated together. The substrates 502 and 504 define between them a number of cavities 506, 508, 510. Exposed within one or more of the cavities are a plurality of wettable pads 512–516. A switching fluid 518 (e.g., a liquid metal such as mercury) is wettable to the pads 512–516 and is held within one or more of the cavities. The switching fluid 518 serves to open and block light paths 522/524, 526/528 through one or more of the cavities, in response to forces that are applied to the switching fluid 518.

By way of example, the light paths may be defined by waveguides 522–528 that are aligned with translucent windows in the cavity 508 holding the switching fluid. Blocking of the light paths 522/524, 526/528 may be achieved by virtue of the switching fluid 518 being opaque. An actuating fluid 520 (e.g., an inert gas or liquid) held within one or more of the cavities serves to apply the forces to the switching fluid 518.

Switch 500 additionally includes corrosion inhibitor 530 (e.g., Cortec VCI-369 or Cortec VCI-327), coating switching fluid 518 within the cavity 508. Corrosion inhibitor 530 may be used to coat switching liquid 518 and prevent corrosion products from forming on the surface of switching liquid 518. Corrosion inhibitor 530 may be transparent, translucent or permit light to pass though it, so as not to interfere with the switching means of this embodiment.

The corrosion inhibitor 530 may be deposited on the liquid metal 518 by means of dispensing or jetting similar to inkjet jetting of droplets.

Figure 5:
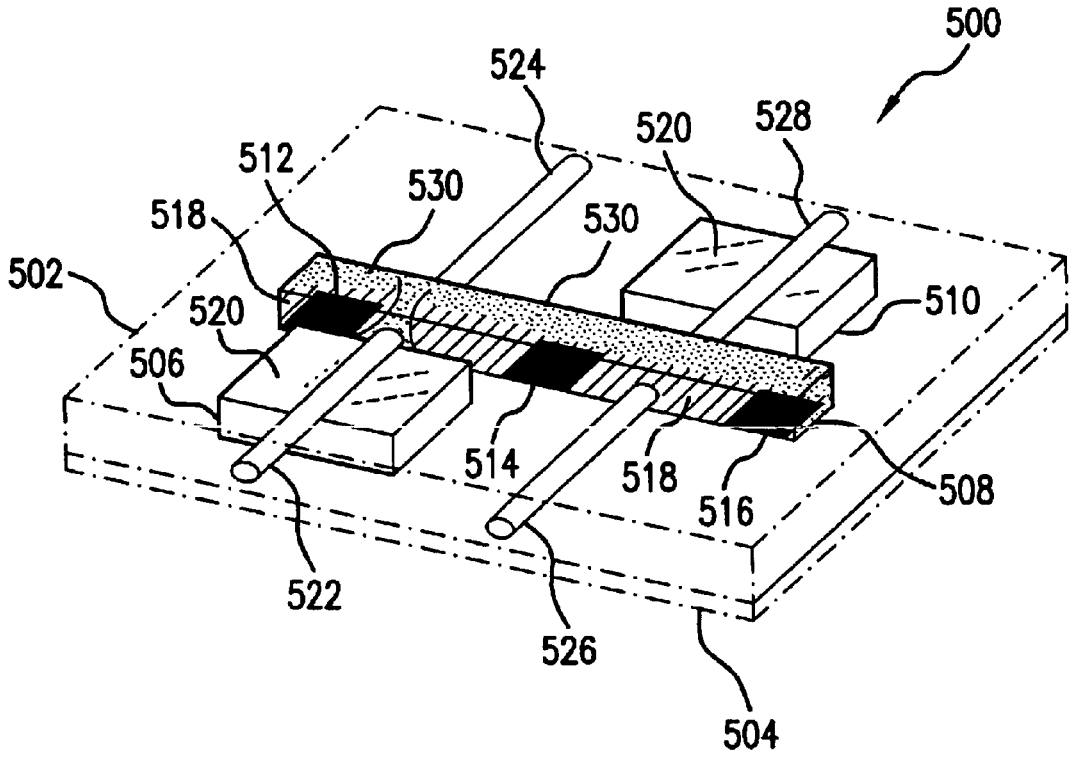
FIG. 5 illustrates a perspective view of another exemplary embodiment of a switch including an oxide or corrosion inhibitor in a fluid based switch.

Additional details concerning the construction and operation of a switch such as that which is illustrated in FIG. 5 may be found in the aforementioned patent of Kondoh et al., and patent application of Marvin Wong.

The corrosion inhibitor may fill the cavity or merely coat the surface of the liquid metal switch.

While illustrative and presently preferred embodiments of the invention have been described in detail herein, it is to be understood that the inventive concepts may be otherwise variously embodied and employed. The appended claims are intended to be construed to include such variations, except as limited by the prior art.

What is claimed is:

1. A method, comprising:

depositing a switching fluid with a surface area on a first substrate;

coating the surface area of the switching fluid with a corrosion inhibitor; and mating the first substrate to a second substrate, the first substrate and the second substrate defining therebetween a cavity holding the switching fluid, the cavity being sized to allow movement of the switching fluid between first and second states.

2. The method of claim 1, wherein the corrosion inhibitor comprises an inert oily substance.

3. The method of claim 1, wherein the corrosion inhibitor comprises a chemical reducing substance.

4. The method of claim 1, wherein the corrosion inhibitor comprises Cortec VCI-369.

5. The method of claim 1, wherein the corrosion inhibitor comprises Cortec VCI-327.

6. The switch of claim 1, wherein the switch is a liquid metal switch.

7. The switch of claim 1, wherein the switching fluid comprises mercury.

8. The switch of claim 7, wherein the corrosion inhibitor comprises an inert oil and a chemical reducer.

9. The switch of claim 1, wherein the switching fluid comprises a gallium alloy.

10. The switch of claim 9, where the corrosion inhibitor comprises an inert oil and a chemical reducing substance.

11. A switch comprising:

first and second mated substrates defining therebetween at least portions of a number of cavities;

a plurality of electrodes exposed within one or more of the cavities;

a switching fluid, held within a first one of the cavities, that serves to open and close at least a pair of the plurality of electrodes in response to forces that are applied to the switching fluid;

a corrosion inhibitor coating the switching fluid; and an actuating fluid, held within one or more of the cavities, that applies the forces to said switching fluid.

12. The switch of claim 11, wherein the corrosion inhibitor comprises an inert oil and a chemical reducer.

13. The switch of claim 11, wherein the corrosion inhibitor comprises Cortec VCI-369.

14. The switch of claim 11, wherein the corrosion inhibitor comprises Cortec VCI-327.

15. A switch comprising:

first and second mated substrates defining therebetween at least portions of a number of cavities;

a plurality of wettable pads exposed within one or more of the cavities;

a switching fluid, wettable to said pads and held within one or more of the cavities, that serves to open and block light paths through one or more of the cavities in response to forces that are applied to the switching fluid;

a corrosion inhibitor coating the switching fluid; and an actuating fluid, held within one or more of the cavities, that applies the forces to said switching fluid.

16. The switch according to claim 15, wherein the corrosion inhibitor comprises an inert oil and a chemical reducer.

17. The switch according to claim 15, wherein the corrosion inhibitor comprises Cortec VCI-369.

18. The switch according to claim 15, wherein the corrosion inhibitor comprises Cortec VCI-327.

* * * * *